US005991423A

United States Patent [19]

Norte

[11] Patent Number: 5,991,423

[45] Date of Patent: Nov. 23, 1999

[54] PLANAR MAGNETIC CONTINUOUS-TONE TRANSDUCER

[75] Inventor: David A. Norte, Westminster, Colo.

[73] Assignee: Lucent Technologies Inc., Murray Hill, N.J.

[21] Appl. No.: 09/157,885

[22] Filed: Sep. 21, 1998

[51] Int. Cl.[6] ..... H04R 25/00

[52] U.S. Cl. ..... 381/396; 381/401; 381/412

[58] Field of Search ..... 381/396, 399, 381/401, 412, 417–419, 421, 431; 336/200, 232, 223

[56] References Cited

U.S. PATENT DOCUMENTS

| | | | |
|---|---|---|---|
| Re. 15,993 | 2/1925 | Peterson | 381/417 |
| 1,569,411 | 1/1926 | Thomas | 381/396 |
| 1,606,571 | 11/1926 | Heising | 381/401 |
| 1,660,864 | 2/1928 | Conrad | 381/396 |
| 1,682,505 | 8/1928 | Hanna | 381/417 |
| 3,584,161 | 6/1971 | Hawley | 381/417 |
| 5,216,723 | 6/1993 | Froeschle et al. | 381/418 |
| 5,861,790 | 1/1999 | Johnson, Jr. et al. | 336/200 |

*Primary Examiner*—Sinh Tran
*Attorney, Agent, or Firm*—Duft, Graziano & Forest, PC

[57] ABSTRACT

The planar magnetic continuous-tone transducer functions as a low power, wide dynamic range speaker. The planar magnetic continuous-tone transducer uses a conventional pair of ferrite cores on which are tightly wound primary and secondary coils. A very small air gap is provided between the two ferrite cores and the secondary coil is left unterminated. The application of a voltage at a selected frequency to the primary coil induces a harmonic force in the open secondary coil, which is transmitted to the two ferrite cores. The harmonic force causes the ferrite cores to vibrate, emitting a tone from the air gap region.

15 Claims, 1 Drawing Sheet

PLANAR MAGNETIC CONTINUOUS-TONE TRANSDUCER

FIELD OF THE INVENTION

This invention relates to continuous-tone transducers and, in particular, to a low power, substantially all-magnetic continuous-tone transducer having a significantly improved lifetime.

PROBLEM

It is a problem in the field of continuous-tone transducers, such as speakers, to produce an adequate volume tone at the desired frequencies with low power and using a structure that is sufficiently long-lived and resistant to damage. The typical continuous-tone transducer that is in use comprises a speaker. The speaker consists of a cross-over electrical network that is coupled to a magnetic coil to produce a magnetically induced vibration. The induced vibrations are amplified and broadcast by means of a paper-type of cone that is coupled to the magnetic coil. This structure is inexpensive and in widespread use. A problem with this structure is that the paper-type cone is susceptible to mechanical damage and has a limited life. In addition, the paper-type cone requires a significant amount of space in comparison to the size of the magnetic coil in order to effectively produce an adequate volume output. Therefore, the paper-type cone speakers are inexpensive, but require a significant amount of space, and are limited in their effective life and availability for use in hostile environments.

SOLUTION

The above-described problems are solved and a technical advance achieved in the field by the present planar magnetic continuous-tone transducer that functions as a low power, wide dynamic range speaker. The planar magnetic continuous-tone transducer uses a conventional pair of ferrite cores on which are tightly wound primary and secondary coils. A very small air gap is provided between the two ferrite cores and the secondary coil is left unterminated. The application of a voltage at a selected frequency to the primary coil induces a harmonic force in the open secondary coil, which is coupled to the two ferrite cores. The coupled harmonic force causes the ferrite cores to vibrate, emitting a tone from the air gap region.

DETAILED DESCRIPTION

Figure 1:
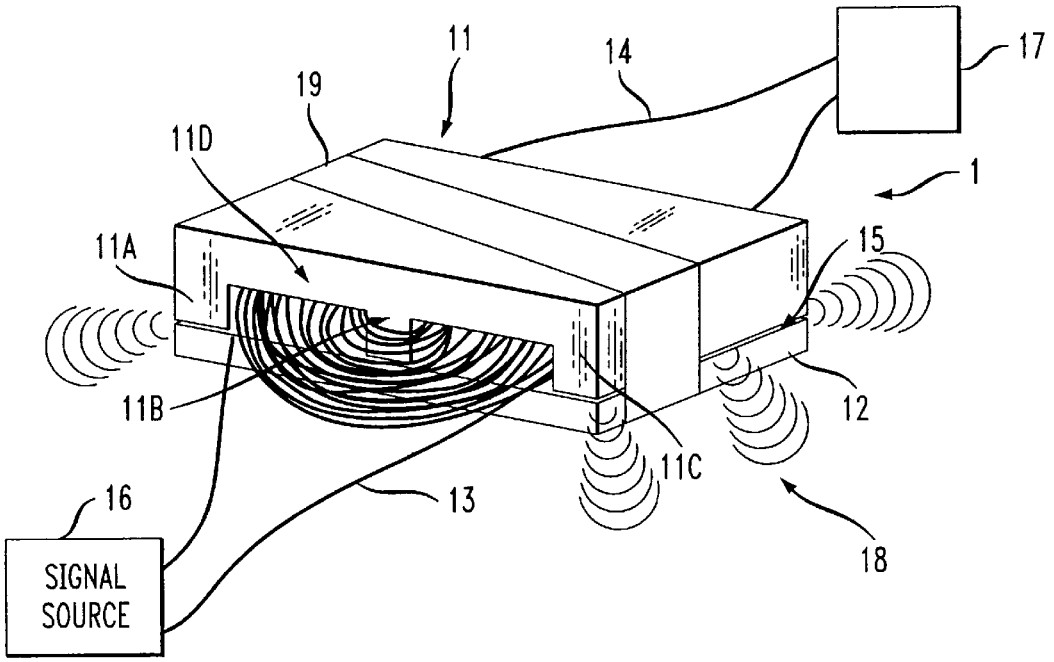
FIG. 1 illustrates a perspective view of the present planar magnetic continuous-tone transducer.
Figure 2:
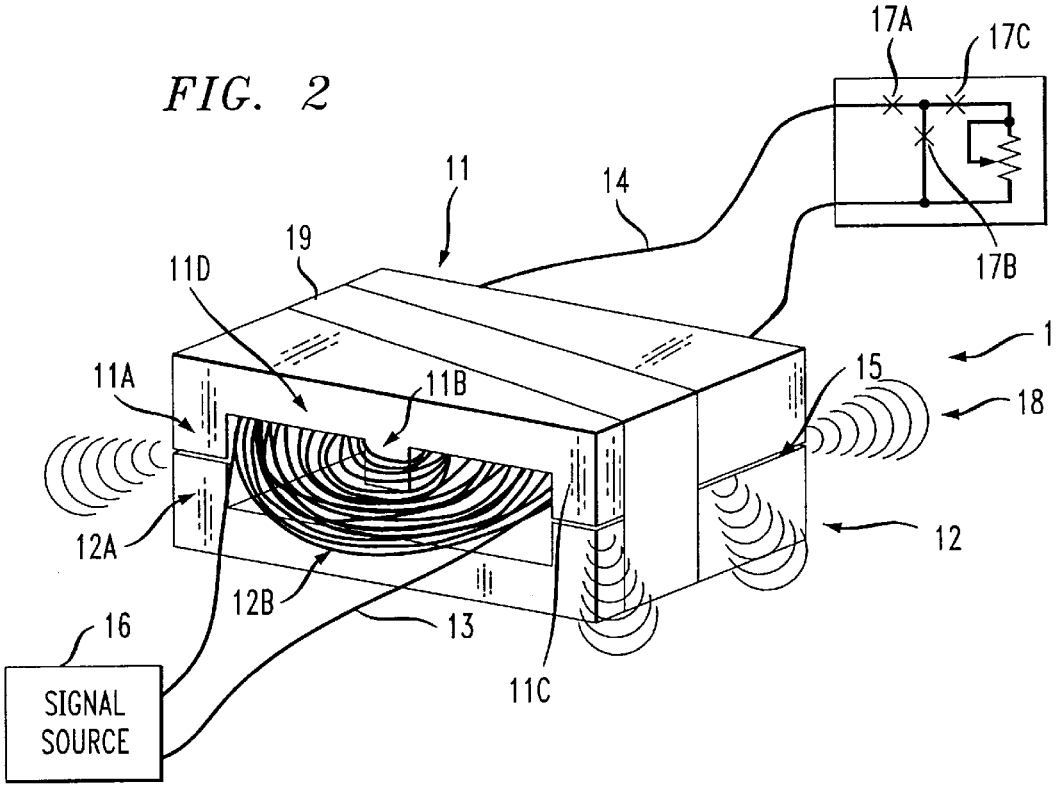
FIG. 2 illustrates a perspective view of an alternate embodiment of the present planar magnetic continuous-tone transducer.

FIGS. 1 and 2 illustrate a perspective view of the present planar magnetic continuous-tone transducer. The planar magnetic continuous-tone transducer 1 uses a conventional pair of ferrite cores 11, 12. At least one of the ferrite cores 11 is an E-shaped ferrite core of conventional manufacture, having three arms 11A–11C that extend from the body 11D of the ferrite core. The other ferrite core 12 can be either an E-shaped ferrite core shown in FIG. 2 or an I shaped ferrite core, as is shown in FIG. 1. The two ferrite cores 11, 12 are positioned in conventional manner as is shown in FIGS. 1 and 2 so that the two ferrite cores form a closed loop to carry the magnetic fields that are generated by a primary coil 13 that is tightly wound on the center leg 11B of the E shaped ferrite core 11. In the embodiment of FIG. 1, the I-shaped ferrite core 12 spans the three arms 11A–11C of the E-shaped ferrite core 11, while in the embodiment of FIG. 2, the three arms 12A–12C of the second ferrite core 12 align with the corresponding three arms 11A–11C of the first ferrite core 11. In both embodiments, the two ferrite cores 11, 12 are physically held together by the use of a band 19 that is manufactured of a robust, flexible material, such as an adhesive backed tape or elastic band member.

A secondary coil 14 is also tightly wound on the center leg 11B of the first E-shaped ferrite core 11, with the primary 13 and secondary 14 coil windings being interleaved or having the primary and secondary coils individually situated one on top of the other. A very small air gap 15 is provided between the two ferrite cores 11, 12 to thereby permit vibration of the two ferrite cores 11, 12. The air gap is created by the primary 13 and secondary 14 windings which prevent the two ferrite cores 11, 12 from physically touching each other, and the air gap is maintained by the bans 19 that holds the ferrite cores 11, 12 together. A signal source 16 for generating a driving voltage signal of frequency $f_1$ is connected to the primary coil 13 and the secondary coil 14 is either left unterminated or connected to an output termination circuit 17, described below. The application of a voltage at a selected frequency to the primary coil 13 induces a harmonic force in the open secondary coil 14, which harmonic force is mechanically transmitted to the two ferrite cores 11, 12. The harmonic force causes the ferrite cores 11, 12 to vibrate, emitting a tone 18 from the air gap region 15. The mechanical vibration of the ferrite cores 11, 12 is microscopic in nature, and cannot be viewed without the aid of a magnification device.

The generation of the tone 18 is controlled either by the selected application of the driving voltage to the primary coil 13 by the signal source 16 or the termination of the secondary coil 14 with either an open circuit (via contact 17A) an impedance (variable impedance 17D or short 17B) by output termination circuit 17, controlling the generation of the harmonic force. If the output termination circuit 17 places a low impedance, such as a short (via contact 17B) across the secondary coil 14, the vibrations are totally quenched and subsequently no audio tones are emitted. If the output termination circuit 17 places an impedance load 17D (via contact 17C) on the secondary coil 12, the vibrations are controllably reduced in amplitude and the output volume of the audible signal is correspondingly reduced. If the output termination circuit 17 places an open circuit via contact 17A across the secondary coil 14, the full audible output is enabled. The audible output that is typically produced by the planar magnetic continuous-tone transducer is between 50 Hz and 8 KHz and of significant volume with a power input to the primary coil 13 of approximately 1 watt.

SUMMARY

The planar magnetic continuous-tone transducer uses a conventional pair of ferrite cores on which are tightly wound primary and secondary coils. A very small air gap is provided between the two ferrite cores and the secondary coil is left unterminated. The application of a voltage at a selected frequency to the primary coil induces a harmonic force in the open secondary coil causing the ferrite cores to vibrate, emitting a tone from the air gap region.

What is claimed:

1. A continuous-tone transducer for generating an audible output in response to a driving electrical signal, comprising:

a first ferrite core having an E-shaped structure comprising first and second legs, each located at a distal end of a body of said first ferrite core, and a middle leg disposed substantially midway between said first and second legs, said first, second and middle legs being arranged in a parallel-spaced apart relationship to form the E-shape;

a primary coil tightly wound on said middle leg of said E-shaped ferrite core;

a secondary coil tightly wound on said middle leg of said E-shaped ferrite core;

a second ferrite core positioned to bridge said first, second and middle legs of said E-shaped first ferrite core and separated therefrom by a predetermined air gap; and means for applying a driving electrical signal to said primary coil to induce a vibration in said first and second ferrite cores to generate said audible output.

2. The continuous-tone transducer of claim 1 wherein said second ferrite core comprises:

a second E-shaped ferrite core comprising first and second legs, each located at a distal end of a body of said second ferrite core, and a middle leg disposed substantially midway between said first and second legs, said first, second and middle legs being arranged in a parallel-spaced apart relationship to form the E-shape, said first, second and middle legs of said second ferrite core being juxtaposed to corresponding first, second and middle legs of said first ferrite core.

3. The continuous-tone transducer of claim 1 wherein said second ferrite core comprises:

an I-shaped ferrite core spanning said first, second and middle legs of said E-shaped first ferrite core.

4. The continuous-tone transducer of claim 1 wherein said secondary coil is unterminated.

5. The continuous-tone transducer of claim 1 further comprising:

means for terminating said secondary coil, having a first unterminated state to enable generation of said audible output and a second terminated state to controllably suppress generation of said audible output.

6. The continuous-tone transducer of claim 5 wherein said means for terminating comprises:

variable impedance means for interposing a controllable magnitude impedance across output terminals of said secondary coil for controllably suppressing generation of said audible output.

7. The continuous-tone transducer of claim 1 wherein said means for applying comprises:

voltage source means for generating an electrical signal of predetermined frequency $f_1$ and predetermined magnitude to induce a vibration in said first and second ferrite cores to generate said audible output.

8. The continuous-tone transducer of claim 1 further comprising:

band means encircling said first ferrite core and said second ferrite core for maintaining said second ferrite core in position to bridge said first, second and middle legs of said E-shaped first ferrite core.

9. A continuous-tone transducer for generating an audible output in response to a driving electrical signal, comprising:

a first ferrite core having an E-shaped structure comprising first and second legs, each located at a distal end of a body of said first ferrite core, and a middle leg disposed substantially midway between said first and second legs, said first, second and middle legs being arranged in a parallel-spaced apart relationship to form the E-shape;

a primary coil tightly wound on said middle leg of said E-shaped ferrite core;

a secondary coil tightly wound on said middle leg of said E-shaped ferrite core;

a second ferrite core positioned to bridge said first, second and middle legs of said E-shaped first ferrite core and separated therefrom by a predetermined air gap formed by at least one of said primary coil and said secondary coil;

band means encircling said first ferrite core and said second ferrite core for maintaining said second ferrite core in position to bridge said first, second and middle legs of said E-shaped first ferrite core; and means for applying a driving electrical signal to said primary coil to induce a vibration in said first and second ferrite cores to generate said audible output.

10. The continuous-tone transducer of claim 9 wherein said means for applying comprises:

voltage source means for generating an electrical signal of predetermined frequency $f_1$ and predetermined magnitude to induce a vibration in said first and second ferrite cores to generate said audible output.

11. The continuous-tone transducer of claim 9 wherein said second ferrite core comprises:

a second E-shaped ferrite core comprising first and second legs, each located at a distal end of a body of said second ferrite core, and a middle leg disposed substantially midway between said first and second legs, said first, second and middle legs being arranged in a parallel-spaced apart relationship to form the E-shape, said first, second and middle legs of said second ferrite core being juxtaposed to corresponding first, second and middle legs of said first ferrite core.

12. The continuous-tone transducer of claim 9 wherein said second ferrite core comprises:

an I-shaped ferrite core spanning said first, second and middle legs of said E-shaped first ferrite core.

13. The continuous-tone transducer of claim 9 wherein said secondary coil is unterminated.

14. The continuous-tone transducer of claim 9 further comprising:

means for terminating said secondary coil, having a first unterminated state to enable generation of said audible output and a second terminated state to controllably suppress generation of said audible output.

15. The continuous-tone transducer of claim 14 wherein said means for terminating comprises:

variable impedance means for interposing a controllable magnitude impedance across output terminals of said secondary coil for controllably suppressing generation of said audible output.

* * * * *